US008453421B2

(12) United States Patent
Tokunaga et al.

(10) Patent No.: US 8,453,421 B2
(45) Date of Patent: Jun. 4, 2013

(54) METHOD OF PACKAGING RECORD ROLLS OF COVER TAPE AND PACKAGE

(75) Inventors: Hisatsugu Tokunaga, Isesaki (JP); Yusuke Tanazawa, Isesaki (JP)

(73) Assignee: Denki Kagaku Kogyo Kabushiki Kaisha, Tokyo (JP)

( * ) Notice: Subject to any disclaimer, the term of this patent is extended or adjusted under 35 U.S.C. 154(b) by 353 days.

(21) Appl. No.: 12/810,425

(22) PCT Filed: Aug. 29, 2008

(86) PCT No.: PCT/JP2008/065531
§ 371 (c)(1),
(2), (4) Date: Jun. 24, 2010

(87) PCT Pub. No.: WO2009/081622
PCT Pub. Date: Jul. 2, 2009

(65) Prior Publication Data
US 2010/0275554 A1 Nov. 4, 2010

(30) Foreign Application Priority Data
Dec. 26, 2007 (JP) ..... 2007-334095

(51) Int. Cl.
*B65B 11/52* (2006.01)

(52) U.S. Cl.
USPC ..... 53/442; 53/557

(58) Field of Classification Search
USPC ..... 53/441, 442, 557
See application file for complete search history.

(56) References Cited

U.S. PATENT DOCUMENTS

| | | | | | |
|---|---|---|---|---|---|
| 3,445,056 | A * | 5/1969 | McCollough | 229/87.2 |
| 3,457,695 | A * | 7/1969 | McCollough et al. | 53/442 |
| 3,851,755 | A * | 12/1974 | Hull et al. | 206/0.82 |
| 4,060,957 | A * | 12/1977 | Birkenfeld et al. | 53/442 |
| 4,282,973 | A * | 8/1981 | Binkowski | 206/308.3 |
| 4,374,563 | A * | 2/1983 | Alexander | 206/499 |
| 4,491,222 | A | 1/1985 | Gaccetta et al. | |
| 5,456,059 | A * | 10/1995 | Limousin | 53/492 |
| RE35,976 | E * | 12/1998 | Gasparrini et al. | 206/209 |
| 6,285,193 | B1 * | 9/2001 | Kamitani | 324/519 |
| 7,694,499 | B2 * | 4/2010 | Ballestrazzi et al. | 53/545 |
| 2005/0126125 | A1 * | 6/2005 | Curtsinger et al. | 53/415 |

FOREIGN PATENT DOCUMENTS

| | | |
|---|---|---|
| JP | 1 133874 | 5/1989 |
| JP | 1 133875 | 5/1989 |
| JP | 2005 186959 | 7/2005 |

* cited by examiner

*Primary Examiner* — Hemant M Desai
(74) *Attorney, Agent, or Firm* — Oblon, Spivak, McClelland, Maier & Neustadt, L.L.P.

(57) ABSTRACT

The method for packaging together a plurality of record rolls of cover tape according to the present invention comprises wrapping a stack obtained by roughly coaxially stacking said record rolls in a heat-shrink film; and heat-shrinking said heat-shrink film, so that a pressure of at least 0.8 mN/mm$^2$ and at most 1.2 mN/mm$^2$ is applied between the record rolls. This method will not deform the rolled state after packaging, while suppressing the occurring of roll collapse when exposed to a high-temperature environment or a low-temperature environment.

14 Claims, 1 Drawing Sheet

METHOD OF PACKAGING RECORD ROLLS OF COVER TAPE AND PACKAGE

TECHNICAL FIELD

The present invention relates to a method of packaging record rolls of cover tape and a package formed thereby. For the purposes of the present invention, a "cover tape" shall refer to a covering tape for application to carrier tape which is used for transporting electronic parts.

BACKGROUND ART

When transporting chip-type electronic parts such as IC's, it is common to use carrier tapes having recesses consecutively formed at standard intervals by embossing a plastic sheet. Chip-type electronic parts are placed in the recesses, and the top surface of the carrier tape is heat-sealed by the cover tape so as to seal the electronic parts inside.

Cover tape is obtained by cutting narrow tapes of film from a wide original sheet, and sold in a state of being rolled in the shape of a record onto a core of about the same width as the cutting width, or in a state of traverse rolling onto a core that is wider than the cutting width. In particular, for the sake of transportation efficiency, it is common to package a plurality of record rolls which have been stacked to form a cylinder.

One example of a conventional method of packaging record rolls of cover tape will be explained with reference to FIG. 2.

In the method shown in FIG. 2, record rolls 3 obtained by winding a cover tape 1 onto a core 2 in the form of a record (FIG. 2*a*) are stacked roughly coaxially to form a cylindrical stack 4 (FIG. 2*b*), the stack 4 is wrapped in a packaging film 10 along its outer circumference (FIG. 2*c*), the packaging film 10 is anchored with adhesive tape 11 (FIG. 2*d*), and the excess at both ends of the packaging film 10 is folded inward and fixed with adhesive tape 11 (FIGS. 2*e* and 2*f*). Next, the resulting package is placed in a packaging bag 12 (FIG. 2*g*), the packaging bag 12 is deaerated by a deaeration device 13 (FIG. 2*h*), and the mouth portion (heat-sealed portion 14) is heat-sealed while maintaining the deaerated state, to finally obtain the package 15 (FIG. 2*i*).

The package 15 is normally further packaged in a cardboard box or the like for transport.

Additionally, as a method of preventing slackening of film tape rolled in the form of a record, a method of placing a record roll of tape into a bag and sealing the bag under reduced pressure has been proposed (Patent Document 1). With this packaging method, the reduced pressure seal enables the bag to snugly contact the entirety of the record roll tape due to the pressure difference inside and outside the bag, thereby securing the record roll tape while at the same time making the package itself highly rigid, as a result of which slackening is prevented. It further describes that the material of the bags can have a heat-shrink property, in which case the loose ends (excess) of the bag jutting from the external diameter of the tape after reduced pressure sealing can be removed, thereby enabling the package volume to be reduced.

Patent Document 1: JP-A 2005-186959

DISCLOSURE OF THE INVENTION

Problems to be Solved by the Invention

However, even with multiple layers of packaging as shown in FIG. 2, when storing or transporting record rolls of cover tape, environmental factors such as temperature and humidity, as well as vibrations and the like can cause the roll shape to deform, and in extreme cases, roll collapse or warping can occur, making them impossible to use.

Additionally, even if the packaging method described in Patent Document 1 is applied to cover tape and the bag heat-shrunk so as to require removal of the loose ends, it is still not sufficient to achieve stability of the rolled state during transport or storage.

Since cover tape has a laminated tape structure in which a heat-seal layer is separately formed on a film layer forming the substrate, it is difficult to make the thickness of the sealing layer strictly uniform, as a result of which there are variations in the thickness. When a tape with such a structure is wound into the shape of a record, gaps occur between the sealing layer of the tape above and the film layer of the tape below, as a result of which air is unavoidably taken in. The air which is taken into the gaps expands and contracts under the strong influence of environmental factors such as temperature changes during storage and transport, so the record rolls can come unwound. For this reason, when rolling cover tape into records, they are notably more susceptible to roll collapse due to environmental changes than record rolls of single-layer film tapes.

Additionally, since cover tapes are used by heat-sealing them to carrier tapes, they exhibit very sensitive behavior to heat. Therefore, if cover tape is left for a long time in a high temperature environment, the heat can cause the heat-seal layer of the cover tape to soften, and the cover tape to stick together in a phenomenon known as blocking. This can result in the problem of not being able to stably draw out the wound cover tape at the time of use. For this reason, when packaging a cover tape in a heat-shrink bag or the like and heat-shrinking, the thermal properties not only of the heat-shrink bag, but also of the cover tape itself must be considered.

However, the above Patent Document 1 does not mention cover tape as an object of packaging, and does not touch upon the special considerations for cover tape or the heat-shrinking conditions when packaging record rolls of cover tape.

Thus, there has been a demand for a method of packaging record rolls of cover tape having uneven thickness and heat-sealing capability without deforming the roll shape due to environmental factors such as temperature, humidity and vibrations during transport and storage, and a package obtained thereby.

The present invention was made in consideration of the above circumstances, and has the object of offering a method of packaging record rolls of cover tape capable of suppressing the occurrence of roll collapse during transport and storage, without deforming the roll shape, and a package obtained thereby.

Means for Solving the Problems

As a result of diligent research toward a method of solving the aforementioned problems, the present inventors discovered that the rolled state during transport and storage of record rolls can be made stable without deforming the roll shape immediately after packaging, by packaging record rolls of cover tape in a heat-shrink film, then heat-shrinking the heat-shrink film so as to apply a specific degree of pressure between the record rolls, thereby achieving the present invention.

The present invention offers a method of packaging together a plurality of record rolls of cover tape, characterized by wrapping a roughly coaxial stack of record rolls in a heat-shrink film, and subjecting said heat-shrink film to thermal contraction, thereby applying a pressure of at least 0.8 $mN/mm^2$ and at most 1.2 $mN/mm^2$ to said record rolls.

Surprisingly, the present inventors found that by applying a pressure of at least 0.8 $mN/mm^2$ and at most 1.2 $mN/mm^2$ to record rolls of cover tape, roll collapse can be prevented even under exposure to high-temperature environments and low-temperature environments, without deforming the rolled state immediately after packaging.

To be specific, they found that applying a pressure of at least 0.8 mN/mm$^2$ between the record rolls is extremely effective for preventing the occurrence of roll collapse during storage and transport in high-temperature environments and low-temperature environments, and in order to apply such a pressure, pressure must be intentionally applied using a heat-shrink film. What deserves special note is that, upon studying conventional packaging methods, the pressure applied between the record rolls was found to be less than 0.8 mN/mm$^2$ (about 0.3-0.5 mN/mm$^2$) when the loose slack (excess) of the bags and film were removed according to common methods of using reduced pressure sealing and heat-shrink films. In other words, a pressure of at least 0.8 mN/mm$^2$ which is sufficient to stabilize the form of the record rolls cannot be achieved without intentionally applying more pressure. Therefore, one factor in the inability to adequately prevent roll collapse of cover tapes due to environmental changes when applying conventional packaging methods seems to be the lack of adequate pressure between the record rolls.

Furthermore, they found that as long as the pressure between record rolls is 1.2 mN/mm$^2$ or less, the tensile stress on the record rolls during contraction of the heat-shrink film will not be excessive, so deformation of the record rolls immediately after packaging can be prevented. In other words, since the tensile stress applied to the stack of record rolls at the time of heat-shrinking will not always be uniform, application of excessive pressure can result in considerable local differences in tensile stress, thus deforming the rolled state immediately after packaging. In particular, as described above, cover tape is structured so as to have uneven thickness and thus to take in air when rolled into records, so that even small local differences in tensile stress can relatively easily result in deformation. However, if the pressure between record rolls is 1.2 mN/mm$^2$ or less, then such deformation will not occur.

Additionally, as mentioned above, if cover tape is excessively heated, the heat can cause the heat-seal layer to soften, resulting in blocking. Therefore, during heat-shrinking, it is necessary to consider not only the contraction properties of the heat-shrink film, but also the heat resistance of the cover tape which is being packaged. Upon making measurements using various combinations of cover tape and heat-shrink films, it was found to be possible to apply a pressure of at least 0.8 mN/mm$^2$ and at most 1.2 mN/mm$^2$ between record rolls without the need for so much heat that blocking occurs.

Thus, the present inventors discovered that in order to stably package a cover tape with specific properties of having thickness variations and having a heat-sealing capability without deforming the rolled shape and without resulting in roll collapse even in high-temperature/low-temperature environments, it is very effective to apply pressure in the specific above-specified range to the record roll of cover tape using a heat-shrink film.

Effects of the Invention

According to the present invention, it is possible to prevent deformation of the roll shape immediately after packaging, and to prevent roll collapse and warping of the record rolls of cover tape during transport and storage. Furthermore, the production steps can be greatly simplified in comparison to conventional packaging methods.

DESCRIPTION OF THE REFERENCE NUMBERS

| | |
|---|---|
| 1 | cover tape |
| 2 | core |
| 3 | record roll |
| 4 | stack |
| 5 | heat-shrink film |
| 6 | heat-sealed portion |
| 7 | package |
| 10 | packaging film |
| 11 | adhesive tape |
| 12 | packaging bag |
| 13 | reduced pressure deaeration device |
| 14 | heat-sealed portion |
| 15 | package |

BEST MODES FOR CARRYING OUT THE INVENTION

Herebelow, an embodiment of the present invention will be explained with reference to the drawings. In all of the drawings, similar structural elements have been assigned similar reference numbers, and their explanations will be omitted where appropriate.

Figure 1:
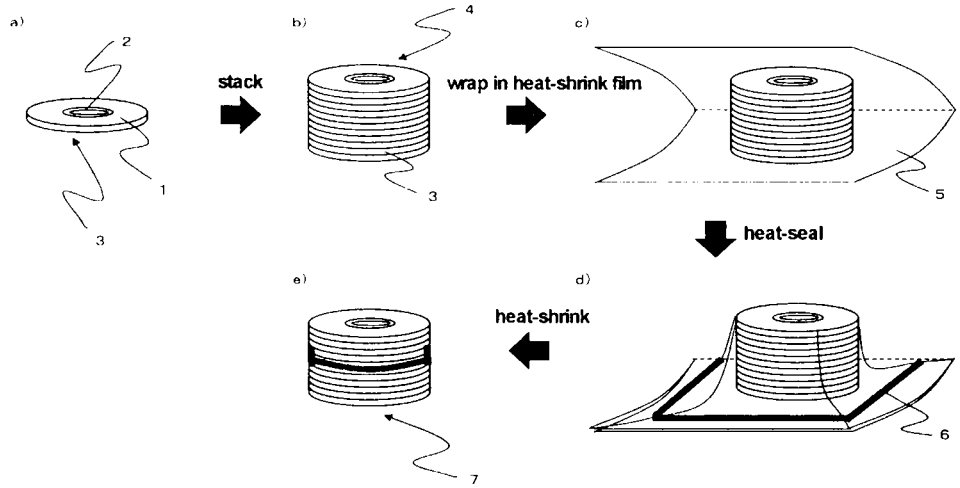
[FIG. 1] A schematic view of an example of a packaging method according to the present invention.
Figure 2:
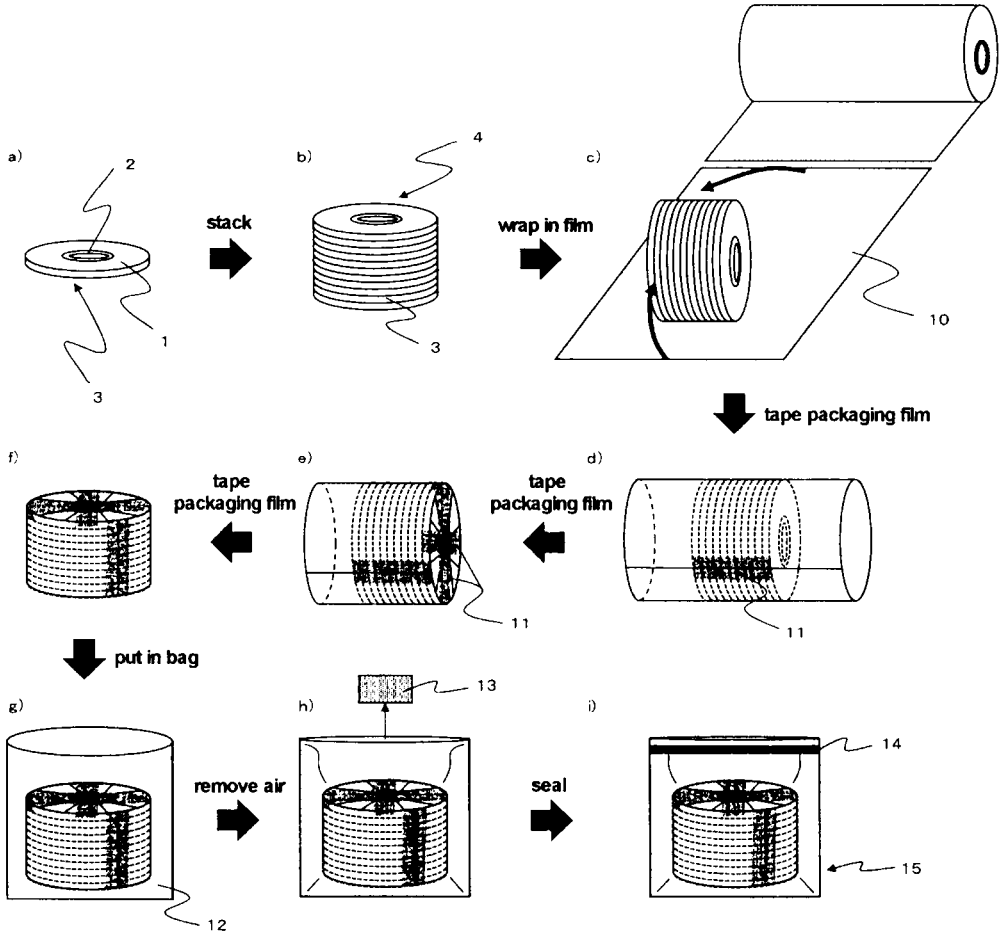
[FIG. 2] A schematic view of an example of a conventional reduced-pressure packaging method.

FIG. 1 is a conceptual diagram for explaining a method for packaging record rolls of cover tape according to the present embodiment.

The method for packaging record rolls of cover tape according to the present embodiment, as shown in FIG. 1, mainly involves using a record roll 3 formed by rolling cover tape 1 onto a core 2 in the shape of a record (FIG. 1*a*), and a heat-shrink film 5 (FIG. 1*c*).

<Cover Tape>

The cover tape 1 refers to a cover tape for use with carrier tape which is generally used for transporting electronic parts, typically composed of a tape-shaped laminar structure integrating a film layer forming a substrate and a heat-seal layer.

While the resin composing the film layer is not particularly limited, possible examples include polyesters such as polyethylene terephthalate (PET), polyethylene naphthalate (PEN) and mixtures of polyethylene terephthalate and polyethylene naphthalate, polyolefins such as polypropylene and polyethylene, polyvinyl chloride resins and styrene resins.

Additionally, while the resin composing the heat-seal layer is not particularly limited, olefin resins, styrene resins, or mixtures thereof can be used. A single or multiple intermediary layers composed of olefin resins or the like may be provided between the film layer and the heat-seal layer.

While the thickness of the cover tape 1 is not particularly limited, it should generally be at least 0.03 mm and at most 2 mm, preferably at most 0.1 mm, and more preferably at most 0.08 mm. A thickness of at least 0.03 mm is preferable because trouble such as tape tearing will be less likely to occur when rolling the cover tape 1 onto the core 2 or drawing out the cover tape 1 from the rolled state. On the other hand, the thickness of the cover tape 1 should preferably be 2 mm or less in view of the ease of handling and the principal applications.

While the width of the cover tape 1 is not particularly limited, it should generally be at least 1 mm and at most 50 mm, preferably at most 10 mm. If the width is at least 1 mm, roll collapse is not likely to occur during transport or storage.

On the other hand, the width of the cover tape 1 should preferably be 50 mm or less for ease of handling during use and the principal applications.

While the length of the cover tape 1 is not particularly limited, when considering the ease of handling, principal applications and actual sales conditions, it will typically be at least 100 m and at most 800 m. Generally, it is more advantageous to have a shorter roll length in order to stably maintain the rolled state.

<Core>

While the core 2 is not particularly restricted, those composed of paper materials or plastic materials can be favorably used. When rolling the cover tape 1, a plastic material is preferably used for the ability to withstand stresses on the core 2 when rolling the cover tape 1. Additionally, a resin to which glass fibers have been added may also be used as a constituent material for the purpose of further increasing the strength of the core 2.

<Heat-Shrink Film>

The heat-shrink film 5 used in the present embodiment may consist of either a single layer or multiple layers, and may be a uniaxially stretched film or a biaxially stretched film.

The material of the heat-shrink film 5 is not particularly limited, but examples include polyolefin resins (PO) such as polyethylene resins (HDPE, LLDPE etc.), polypropylene resins (PP), polybutene-1 resins (PB) and poly-4-methylpentene-1 resin, modified polyolefin (modified PO) resins such as ethylene-vinyl acetate copolymer resins (EVA), ethylene-methacrylate copolymer resins (EMA etc.) and ethylene-vinyl alcohol copolymer resins (EVOH etc.), aliphatic polyester resins (PEST) such as polyethylene terephthalate (including modified) resins (PET etc.), polybutylene terephthalate (including modified) resins (PBT etc.), polylactate resins and polyglycolate resins, chloride resins such as polyvinylidene chloride resins (PVDC) and polyvinyl chloride resins (PVC), polystyrene (PS) resins such as styrene-butadiene block copolymers, styrene-butadiene-styrene block copolymers and styrene-butyl(meth)acrylate copolymers, α-olefin-carbon monoxide copolymer resins (including hydrate resins), α-olefin (ethylene, etc.)-styrene copolymer resins (including hydrate resins), ethylene-cyclic hydrocarbon compound copolymer resins (including hydrate resins), polyamide resins (Ny) and caprolactone resins.

In the packaging method of the present embodiment, it is particularly preferable to use a polyethylene resin, a chloride resin or a polystyrene resin due to the high sealing strength, high contraction stress and excellent strength when heat-sealing the heat-shrink film 5.

Additionally, thermal stabilizers, optical stabilizers, optical absorbers, lubricants, plasticizing agents, inorganic fillers, colorants and pigments may be added as needed.

While the dimensions of the heat-shrink film 5 are not particularly restricted as long as it is large enough to wrap the entirety of a stack 4 of a plurality of record rolls 3 of cover tape, they should preferably be held to the minimum dimensions required in view of economic factors, work efficiency and applying sufficient pressure to the record rolls 3.

The thickness of the heat-shrink film 5 should be at least 0.01 mm and at most 0.03 mm, more preferably at most 0.02 mm. The thickness is preferably 0.01 mm or more for ease of handling and to prevent trouble such as tearing due to thermal contraction. On the other hand, the thickness of the heat-shrink film 5 should preferably be 0.03 mm or less to enable the heat-shrinking time to be shortened and to make the cover tape less susceptible to blocking.

The heat-shrink film 5 used in the present embodiment, when left for 2 minutes at 90° C., should preferably have a thermal contraction rate of at least 4.0% and at most 35.0% with respect to the dimensions before heating. If the thermal contraction rate is at least 4.0%, adequate pressure can be applied between the record rolls 3 of the cover tape, thus suppressing the occurrence of deformations of the rolled state and roll collapse of the record rolls 3. On the other hand, as will be described below, the mouth of the heat-shrink film 5 is heat-sealed after wrapping the stack 4 and before performing heat-shrinking, and in this case, the thermal contraction rate should preferably be 35.0% or less in order to prevent the sealed portion from coming apart.

In view of the above, the heat-shrink film 5 should particularly satisfy all of the following conditions (1) to (3):

(1) the heat-shrink film should be composed of a polyethylene resin, a chloride resin or a polystyrene resin;

(2) the thickness of the heat-shrink film should be at least 0.01 mm and at most 0.03 mm; and (3) when left for 2 minutes at 90° C., the thermal contraction rate of the heat-shrink film with respect to the dimensions prior to heating should be at least 4.0% and at most 35.0%. In this case, the pressure necessary between the record rolls 3 can be reliably achieved without requiring so much heat as to cause blocking of the record rolls 3 of the cover tape.

<Packaging Method>

The packaging method of the present embodiment shall be explained with reference to FIG. 1.

First, record rolls 3 of cover tape are stacked roughly coaxially, to obtain a cylindrical stack 4 (FIG. 1*b*). The number of record rolls 3 constituting the stack 4 is not particularly restricted, but should preferably be at least 2 and at most 30, more preferably at least 5 and at most 20. If less than 2, the rigidity of the stack 4 can be too low, so that a slight unevenness in the local tensile stresses on the record rolls 3 caused by the heat-shrink film 5 can result in deformation of the record rolls 3 such as warping. Additionally, it is not realistic in view of packaging efficiency, transportation efficiency and economization. On the other hand, if the number of layers exceeds 30, then it becomes difficult to make fine adjustments to the constrictive pressure due to thermal contraction of the heat-shrink film 5 acting on each record roll 3 of cover tape, as a result of which stabilization of the rolled state of the record rolls 3 may not be able to be adequately achieved.

Next, a heat-shrink film 5 of adequate dimensions to wrap the entirety of the stack 4 is used to wrap the stack 4 (FIG. 1*c*). In the present embodiment, the heat-shrink film 5 is folded in half, and the stack 4 is sandwiched in between, but other wrapping methods are possible as long as they are capable of applying the predetermined pressure to be described below between the plurality of record rolls 3 of cover tape constituting the stack 4.

Next, the opening (heat-sealed portion 6) of the heat-shrink film 5 is heat-sealed with the stack 4 wrapped inside (FIG. 1*d*). At this time, if the opening of the heat-shrink film 5 is entirely heat-sealed so as to result in a complete seal, the air contained in the package will not be able to escape when heat-shrinking the package, in which case the heat-shrink film 5 will form a balloon, and the predetermined pressure will not be able to be applied between the record rolls 3 forming the stack 4. For this reason, it is necessary to leave a slight opening not sealed in order to allow the air to escape, or to provide pores in the heat-shrink film 5.

After sealing, the resulting package is passed through a heating furnace to contract the heat-shrink film 5. At this time, the heating conditions are appropriately set as described below so as to apply a predetermined pressure between the plurality of record rolls 3 constituting the stack 4 by heat-shrinking the heat-shrink film 5 to constrict the stack 4.

The package 7 obtained by heat-shrinking in this way may further be placed inside a packaging bag for the purpose of preventing intrusion of contaminants such as dust or insects. Additionally, as in the conventional manner, they may be placed in cardboard boxes or the like for transport.

<Heat-Shrink Conditions>

(Heating Conditions)

While the heating conditions when using the heat-shrink film 5 for heat-shrink packaging will depend on the material of the cover tape 1 used and the material and thermal contraction rate of the heat-shrink film 5, typically, the air temperature should preferably be at least 120° C. and at most 140° C., and the heating time should be at least 8 seconds, more preferably at least 10 seconds, and at most 15 seconds, more preferably at most 12 seconds, in order to prevent blocking of the cover tape 1 and peeling of the heat-sealed portion 6 of the heat-shrink film 5.

(Pressure Measurement and Adjustment)

While the method of measuring the pressure between the record rolls 3 is not particularly restricted, it is preferable, for example, to use an elastic body as a medium, based on the relationship between the pressure applied to the elastic body and the elastic deformation of the medium. As an easier method of measuring the pressure, a film-type pressure sensor may be used.

In order to adjust the pressure between the record rolls 3, for example, the above-described elastic body is sandwiched between the record rolls 3 constituting a stack 4, the stack 4 is wrapped in the predetermined heat-shrink film 5 and heated under various conditions, and the compression effects at those heating conditions are computed from the degree of contraction of the elastic body, to prepare beforehand a standard plot of the heating conditions versus the compression effects characteristic of that heat-shrink film 5. By appropriately selecting the heat-shrink film 5 and the heating conditions based on the standard plot of heating conditions versus compression effects obtained in this way, it is possible to apply a desired pressure of at least 0.8 $mN/mm^2$ and at most 1.2 $mN/mm^2$ between the record rolls of the cover tape.

While embodiments of the present invention have been described above with reference to the drawings, these are merely illustrative of the present invention, and various other constitutions may be employed aside from the above.

For example, while the heat-shrink film 5 was folded in half and the stack 4 was sandwiched in between as the packaging format in the above embodiment, it is possible to sandwich the stack 4 between two sheets of the heat-shrink film 5 and heat-seal the four sides. In this case, the packaging line can be made even more efficient due to the lack of the extra step of folding the heat-shrink film 5 in half.

EXAMPLES

Herebelow, the present invention will be further explained by providing examples, but the present invention is not to be construed as being limited thereby.

Examples 1-4 and Comparative Examples 1-2

A cover tape obtained by cutting a width of about 5 mm from an original sheet 440 mm wide formed by laminating and integrating a substrate layer consisting of 16 μm thick polyethylene terephthalate, a middle layer consisting of 38 μm thick polyethylene resin and a heat-seal layer consisting of 8 μm thick styrene resin was rolled into the form of a record at a winding rate of 50 m/min onto a styrene copolymer synthetic resin core with a radius of 46.5 mm. A stack of 20 of these record rolls of cover tape was sandwiched by a heat-shrink film (Sealed Air D-955) consisting of 0.02 mm thick polyethylene resin with a thermal contraction rate of 10% which was folded in half, and the mouth portion was heat-sealed, then subjected to heat-shrinking at an air temperature of 130° C. for various heating times, to obtain packages.

Comparative Example 3

A stack of cover tapes similar to the above was placed in a packaging bag (Sunpoly Poly Standard Bag No. 20) composed of a polyethylene resin, and as in conventional reduced pressure sealing, deaerated to a level in which the slack (excess) of the bag was removed, then heat-sealed while maintaining the deaerated state to obtain a package.

<Evaluation of Package>

The packages obtained in Examples 1-4 and Comparative Examples 1-3 above were evaluated as indicated below.

Evaluation of Rolled State Immediately After Packaging

The rolled state of the record rolls of cover tape immediately after packaging was evaluated by the senses or by eye according to the below-indicated criteria.

O (good): No difference in tightness or rolled state of cover tape from before packaging.

Δ (fair): Slight deformation of rolled state of cover tape, but allowable in practice.

X (poor): Considerable deformation of rolled state of cover tape, and blocking between cover tapes.

High Temperature Environment Endurance Test

The packages were placed in boxes composed of cardboard with a thickness of about 7 mm, with inner dimensions of length about 220 mm×width about 220 mm×height about 180 mm, and left for 2 hours in an oven set to 80° C. After removing the packages from the oven, they were left for at least 24 hours in an environment of temperature 23° C. and humidity 50%, then extracted from the boxes, and the rolled state of the record rolls of cover tape were evaluated by eye according the criteria indicated below.

O (good): No slackening, roll collapse or warping observed by eye.

Δ (fair): Some slackening, roll collapse or warping observed by eye, but allowable in practice.

X (poor): Considerable slackening, roll collapse or warping observed by eye.

Low-Temperature Environment Endurance Test

Packages were left for 30 minutes in a refrigerator set to 3° C. without placing them in cardboard boxes, then removed to an environment of temperature 23° C. and humidity 50%, after which vibration tests were performed for 30 minutes at 4.2 Hz. Then, they were left for at least 24 hours in an environment of temperature 23° C. and humidity 50%, after which the rolled state of the record rolls of cover tape was evaluated by eye according to the following criteria.

O (good): No slackening, roll collapse or warping observed by eye.

Δ (fair): Some slackening, roll collapse or warping observed by eye, but allowable in practice.

X (poor): Considerable slackening, roll collapse or warping observed by eye.

The heat-shrink times, pressure applied between the record rolls and evaluation results for each of the examples and comparative examples are shown below in Table 1.

TABLE 1

| | Treatment Temp (° C.) | Time (sec) | State After Packaging | Hi-Temp Test | Lo-Temp Test | Pressure (mN/mm$^2$) |
|---|---|---|---|---|---|---|
| Example 1 | 130 | 8 | ○ | Δ | Δ | 0.89 |
| Example 2 | 130 | 10 | ○ | ○ | ○ | 0.96 |
| Example 3 | 130 | 12 | ○ | ○ | ○ | 1.10 |
| Example 4 | 130 | 15 | Δ | ○ | ○ | 1.12 |
| Comparative Example 1 | 130 | 6 | ○ | X | X | 0.42 |
| Comparative Example 2 | 130 | 20 | X | n/a | n/a | 1.14 |
| Comparative Example 3 | — | — | ○ | X | X | 0.31 |

Note)
In Table 1, "n/a" refers to situations in which considerable deformation and blocking was already observed in the state immediately after packaging, so the high-temperature environment test and the low-temperature environment test were not subsequently performed.

The results of Table 1 show that the combination of cover tape and heat-shrink film was capable of preventing roll collapses even under exposure to high-temperature environments and low-temperature environments, without deforming the rolled state immediately after packaging, by applying a pressure of at least 0.8 mN/mm$^2$ and at most 1.2 mN/mm$^2$ between the record rolls forming a stack (Examples 1-4).

On the other hand, sufficient stability of the rolled state was not able to be achieved when applying just enough thermal contraction to remove the slack (excess) of the heat-shrink film in accordance with common methods using heat-shrink films (Comparative Example 1) and when performing reduced pressure packaging sufficient only to reduce the volume of the package. In these cases, the pressure applied between the record rolls was found not to reach 0.8 mN/mm$^2$.

Furthermore, if heated more than necessary, blocking was found to occur in the cover tape, or the cover tape was deformed, or the rolled state became unstable (Comparative Example 2). On the other hand, as shown in Example 4, when 1.12 mN/mm$^2$ was applied between the record rolls forming a stack, some deformation occurred, albeit of a level that is acceptable in practice, in the record rolls immediately after packaging, so no more pressure, i.e. heat, is necessary.

Example 5 and Comparative Examples 4-6

Furthermore, record rolls of cover tape and heat-shrink films similar to the above were used to perform heat-shrinking with different numbers of record rolls in the stacks, treatment temperature and treatment time, and as in the above, evaluations were performed on the rolled state immediately after packaging, and stability of the rolled state in a high-temperature environment and a low-temperature environment.

The evaluation results are shown below in Table 2.

TABLE 2

| | Number of Rolls in Stack | Treatment Temp (° C.) | Time (sec) | State After Packaging | Hi-Temp Test | Lo-Temp Test |
|---|---|---|---|---|---|---|
| Example 5 | 20 | 140 | 12 | ○ | ○ | ○ |
| Comparative Example 4 | 20 | 150 | 10 | Δ | Δ | Δ |
| Comparative Example 5 | 1 | 130 | 10 | Δ | Δ | Δ |
| Comparative Example 6 | 35 | 130 | 10 | ○ | Δ | Δ |

The results of Table 2 show that with the combination of the cover tape and heat-shrink film, the rolled state immediately after packaging was not deformed and roll collapse did not occur even when exposed to a high-temperature environment and a low-temperature environment, even when heating for 12 seconds at a heating temperature of 140° C., but blocking occurred and the rolled state immediately after packaging was deformed when heated for 10 seconds at a heating temperature of 150° C.

Example 5 and Comparative Example 4

Furthermore, when there was only one record roll in a stack, the low rigidity of the record roll caused the rolled state to deform with contraction (Comparative Example 5), while on the other hand, when there were 35 rolls in a stack, the constrictive pressure due to thermal contraction of the heat-shrink film applied per record roll of cover tape was insufficient, so that roll collapse occurred when exposed to high-temperature environments and low-temperature environments (Comparative Example 6).

While no specific data are shown, a pressure in the range of 0.8 mN/mm$^2$ to 1.2 mN/mm$^2$ can be applied in an air temperature of 120° C. to 140° C. as with the above-described Examples 1-5, even when using, instead of the above-described heat-shrink films, a heat-shrink film composed of a polyethylene resin having a thermal contraction rate of 8.0% with a thickness of 0.015 mm (Sealed Air D-940), a heat-shrink film (Nippon Carbide Hi-S film) composed of a polyvinyl chloride resin having a thermal contraction rate of 27% with a thickness of 0.015 mm, or a heat-shrink film (Toko Materials Industries New-Hi Hi-Tube OPS) composed of a polystyrene resin having a thermal contraction rate of 30% with a thickness of 0.02 mm, in which case the rolled state will not deform after packaging and roll collapse will not occur even when exposed to a high-temperature environment or a low-temperature environment.

The present invention has been described with reference to examples above.

These examples are merely illustrative, and those skilled in the art will recognize that various modifications are possible, and that such modifications also lie within the scope of the present invention.

The invention claimed is:

1. A method of packaging together a plurality of record rolls of cover tape, comprising:

wrapping a stack obtained by roughly coaxially stacking said record rolls in a heat-shrink film; and heat-shrinking said heat-shrink film, so that a pressure of at least 0.8 mN/mm$^2$ and at most 1.2 mN/mm$^2$ is applied between said record rolls;

wherein said heat-shrinking is performed in an air temperature of at least 120° C. and at most 140° C.

2. The method of packaging in accordance with claim 1, wherein said heat-shrinking is performed for a treatment time of at least 8 seconds and at most 15 seconds.

3. The method of packaging in accordance with claim 1, wherein said heat-shrink film is composed of a polyethylene resin, a chloride resin or a polystyrene resin; has a thickness of at least 0.01 mm and at most 0.03 mm; and has a thermal contraction rate with respect to the dimensions before heating of at least 4.0% and at most 35.0% when left for 2 minutes at 90° C.

4. The method of packaging in accordance with claim 1, wherein the number of stacked record rolls is at least 2 and at most 30.

5. A package packaged by the method of packaging in accordance with claim 1.

6. The method of packaging according to claim 1, wherein the cover tape has a laminated tape structure in which a heat-seal layer is formed on a film layer that forms a substrate.

7. The method of packaging according to claim 6, wherein the film layer comprises at least one resin selected from the group consisting of a polyester, a polyolefin, a polyvinyl chloride resin, and a styrene resin.

8. The method of packaging according to claim 6, wherein the heat-seal layer comprises at least one resin selected from the group consisting of an olefin resin and a styrene resin.

9. The method of packaging according to claim 1, wherein the cover tape has a thickness of at least 0.03 mm and at most 2 mm.

10. The method of packaging according to claim 1, wherein the cover tape has a width of at least 1 mm and at most 50 mm.

11. The method of packaging according to claim 1, wherein the cover tape has a length of at least 100 m and at most 800 m.

12. The method of packaging according to claim 1, wherein the heat-shrink film has a thickness of at least 0.01 mm and at most 0.03 mm.

13. The method of packaging according to claim 1, wherein the heat-shrink film comprises at least one resin selected from the group consisting of a polyolefin resin, a modified polyolefin resin, an aliphatic polyester resin, a chloride resin, a polystyrene resin, an α-olefin-carbon monoxide copolymer resin, an α-olefin-styrene copolymer resin, an ethylene-cyclic hydrocarbon compound copolymer resin, a polyamide resin, and a caprolactone resin.

14. The method of packaging according to claim 1, wherein said heat-shrinking is performed for a treatment time of at least 10 seconds and at most 12 seconds.

* * * * *